US008698428B2

(12) United States Patent
Kumar et al.

(10) Patent No.: US 8,698,428 B2
(45) Date of Patent: Apr. 15, 2014

(54) THREE LIGHT LEVEL ELECTRONIC BALLAST

(75) Inventors: Nitin Kumar, Burlington, MA (US); Shashank Bakre, Woburn, MA (US); Driss Baba, Swampscott, MA (US); Thomas Schalton, Beverly, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 408 days.

(21) Appl. No.: 13/226,922

(22) Filed: Sep. 7, 2011

(65) Prior Publication Data

US 2013/0057172 A1 Mar. 7, 2013

(51) Int. Cl.
*H05B 37/02* (2006.01)

(52) U.S. Cl.
USPC ..... 315/308; 315/200 R; 315/224

(58) Field of Classification Search
USPC ..... 315/200 R, 209 R, 224, 225, 291, 307, 315/308
See application file for complete search history.

(56) References Cited

U.S. PATENT DOCUMENTS 6,316,883 B1 * 11/2001 Cho et al. ..... 315/247
8,581,501 B2 * 11/2013 Shertok et al. ..... 315/158

* cited by examiner

*Primary Examiner* — Jimmy Vu
(74) *Attorney, Agent, or Firm* — Shaun P. Montana

(57) ABSTRACT

A three light level electronic ballast, and methods of operating lamps at three light levels, are provided. The ballast includes a rectifier, a power factor correction circuit, an inverter circuit, a first circuit, a second circuit, and a control circuit. The rectifier receives an AC voltage signal and produces a rectified voltage signal, which the power factor correction circuit receives and uses to provide a corrected voltage signal. The inverter circuit receives the corrected voltage signal and provides an energizing signal to power at least two lamps. The first circuit selectively reduces the current applied to the lamps by the energizing signal. The second circuit selectively prevents the second lamp from being energized by the energizing signal. The control circuit controls the first circuit and the second circuit.

18 Claims, 4 Drawing Sheets

THREE LIGHT LEVEL ELECTRONIC BALLAST

TECHNICAL FIELD

The present invention relates to lighting, and more specifically, to electronic ballasts for lamps.

BACKGROUND

Multiple level lighting systems, such as three level lighting systems, are used in various lighting applications. For example, three level lighting systems are commonly used in overhead lighting. Such lighting systems allow for conserving energy, because they allow a portion of the lighting to be turned off when the full light level is not necessary.

A typical implementation of a three level lighting system includes three power switches and three ballasts, where each power switch controls only one of the ballasts. Turning on all three of the switches at the same time powers the three ballasts, thus producing full light output. Turning on only two of the switches applies power to only two of the ballasts, producing a reduced light level and a corresponding reduction in power consumed. Turning on only one of the switches applies power to only one of the ballasts, resulting in a further reduced light level and a corresponding reduction in power consumed.

SUMMARY

Typical three level lighting systems, however, suffer for an overuse of components, in that three ballasts and a switch for each ballast are required in the typical configuration. It is more economical to have a single ballast in the lighting system, and to have that ballast include three controllers, each of which controls a lamp set. In order to shut off a lamp set, the supply voltage to the controller corresponding to the lamp set is pulled down (e.g., grounded), so that the controller is disabled. While this configuration reduces the number of components, and thus the cost, of a three level lighting system, it is not energy efficient. Even though one or two controllers may be disabled at any given time, the supply voltage for that controller is still being pulled from the power supply.

Embodiments of the present invention provide an improved three level lighting system that does not suffer from the deficiencies described above. In some embodiments, a ballast selectively energizes at least first and second lamps at a lighting level selected from a plurality of lamp lighting levels. A rectifier receives an alternating current (AC) voltage signal and produces a rectified voltage signal therefrom. After power factor correction, an inverter circuit provides an energizing signal for powering the first and second lamps. A first circuit selectively reduces the current applied to the first and second lamps by the energizing signal. A second circuit selectively prevents the energizing by the energizing signal of the second lamp. A control circuit controls the first circuit to selectively reduce current applied to the lamps and controls the second circuit to selectively prevent the energizing of the second lamp.

In other embodiments, the above-described ballast includes a first switch adapted for selectively connecting the ballast to a first high voltage terminal of an AC power supply, the first switch having an on state and an off state. The above ballast may include a second switch adapted for selectively connecting the power converter to a second high voltage terminal of the AC power supply, the second switch having an on state and an off state.

In an embodiment, there is provided a ballast. The ballast includes: a rectifier to receive an alternating current (AC) voltage signal and produce a rectified voltage signal therefrom; a power factor correction circuit to receive the rectified voltage signal and provide a corrected voltage signal; an inverter circuit to receive the corrected voltage signal and provide an energizing signal that powers a first lamp and a second lamp; a first circuit to selectively reduce the current applied to the first lamp and the second lamp by the energizing signal; a second circuit to selectively prevent the second lamp from being energized by the energizing signal; and a control circuit to control the first circuit to selectively reduce current applied to the first lamp and the second lamp, and to control the second circuit to selectively prevent the energizing of the second lamp.

In a related embodiment, the control circuit may include a first control mode, a second control mode, and a third control mode, wherein in the first control mode, the control circuit may control the first circuit so as to not reduce the current applied to the first and second lamps by the energizing signal and the second circuit so as to not prevent the second lamp from being energized by the energizing signal; in the second control mode, the control circuit may control the first circuit so as to reduce the current applied to the first and second lamps by the energizing signal and the second circuit so as to not prevent the second lamp from being energized by the energizing signal; and in the third control mode, the control circuit may control the first circuit so as to reduce the current applied to the first lamp by the energizing signal and the second circuit so as to prevent the second lamp from being energized by the energizing signal.

In a further related embodiment, at least a third lamp may be in parallel with the first lamp and the first circuit may selectively reduce the current applied to the first lamp, the second lamp, and the third lamp by the energizing signal and the control circuit may include a first control mode, a second control mode, and a third control mode, wherein: in the first control mode, the control circuit may control the first circuit so as to not reduce the current applied to the first lamp, the second lamp, and the third lamp by the energizing signal, and may control the second circuit so as to not prevent the second lamp from being energized by the energizing signal; in the second control mode, the control circuit may control the first circuit so as to reduce the current applied to the first lamp, the second lamp, and the third lamp by the energizing signal, and may control the second circuit so as to not prevent the second lamp from being energized by the energizing signal; and in the third control mode, the control circuit may control the first circuit so as to reduce the current applied to the first lamp and the third lamp by the energizing signal, and may control the second circuit so as to prevent the second lamp from being energized by the energizing signal.

In yet another embodiment, the ballast may further include: a first isolating circuit interconnecting the control circuit to the first circuit; and a second isolating circuit interconnecting the control circuit to the second circuit; wherein the first isolating circuit and the second isolating circuit may be isolated from each other and from the control circuit. In a further related embodiment, the first isolating circuit and the second isolating circuit may each include an optocoupler and at least one solid state switch. In another further related embodiment, the first isolating circuit may include a first optocoupler controlling a switch array to selectively bypass a capacitor in series with the first lamp and the second lamp, and the second isolating circuit may include a second optocoupler controlling a switch to selectively connect a short circuit in parallel with the second lamp.

In still another related embodiment, the first circuit may include a capacitive device connected in series with the first lamp and a short circuit selectively connected in parallel with the capacitive device, and the second circuit may include a short circuit selectively connected in parallel with the second lamp.

In another embodiment, there is provide a ballast to selectively energize at least a first lamp and a second lamp at a lighting level selected from a plurality of lamp lighting levels. The ballast includes: a first switch adapted to selectively connect the ballast to a first high voltage terminal of an AC power supply, the first switch having an on state and an off state; a second switch adapted to selectively connect a power converter to a second high voltage terminal of the AC power supply, the second switch having an on state and an off state; a rectifier to receive an alternating current (AC) voltage signal and produce a rectified voltage signal therefrom; a power factor correction circuit to receive the rectified voltage signal and provide a corrected voltage signal; an inverter circuit to receive the corrected voltage signal and providing an energizing signal to power the first lamp and the second lamp; a first circuit to selectively reduce the current applied to the first lamp and the second lamp by the energizing signal; a second circuit to selectively prevent the second lamp from being energized by the energizing signal; and a control circuit responsive to the first switch and the second switch to selectively control the first circuit and the second circuit.

In a related embodiment, the control circuit: in response to the first switch being in an off state and the second switch being in an on state, may control the first circuit and the second circuit in a first mode in which the first circuit does not reduce the current applied to the first lamp and the second lamp by the energizing signal and the second circuit does not prevent the second lamp from being energized by the energizing signal, such that both the first lamp and the second lamp are operated at a maximum lamp lighting level in the plurality of lamp lighting levels; in response to the first switch being in an on state and the second switch being in an on state, may control the first circuit and the second circuit in a second mode in which the first circuit reduces the current applied to the first lamp and the second lamp by the energizing signal and the second circuit does not prevent the second lamp from being energized by the energizing signal, such that both the first lamp and the second lamp are operated at a 60% lamp lighting level in the plurality of lamp lighting levels; and in response to the first switch being in an on state and the second switch being in an off state, may control the first circuit and the second circuit in a third mode in which the first circuit reduces the current applied to the first lamp by the energizing signal and the second circuit prevents the second lamp from being energized by the energizing signal, such that the first lamp is operated at the 60% lamp lighting level in plurality of lamp lighting levels.

In a further related embodiment, at least a third lamp may be in parallel with the first lamp and the first circuit may selectively reduce the current applied to the first, second and third lamps by the energizing signal and the control circuit may control the first and second circuits: in a first mode in which the first circuit does not reduce the current applied to the first, second and third lamps by the energizing signal and the second circuit does not prevent the second lamp from being energized by the energizing signal; in a second mode in which the first circuit reduces the current applied to the first, second and third lamps by the energizing signal and the second circuit does not prevent the second lamp from being energized by the energizing signal; and in a third mode in which the first circuit reduces the current applied to the first and third lamps by the energizing signal and the second circuit prevents the second lamp from being energized by the energizing signal.

In another related embodiment, the ballast may further include: a first isolating circuit interconnecting the control circuit to the first circuit; and a second isolating circuit interconnecting the control circuit to the second circuit; wherein the first isolating circuit and the second isolating circuit may be isolated from each other and from the control circuit. In a further related embodiment, each isolating circuit may include an optocoupler and at least one solid state switch. In another further related embodiment, the first isolating circuit may include a first optocoupler controlling a switch array to selectively bypass a capacitor in series with the lamps and the second isolating circuit may include a second optocoupler controlling a switch to selectively connect a short circuit in parallel with the second lamp.

In still another related embodiment, the first circuit may include a capacitive device connected in series with the first lamp and a short circuit selectively connected in parallel with the capacitive device, and the second circuit may include a short circuit selectively connected in parallel with the second lamp.

In another embodiment, there is provided a method of selectively energizing at least a first lamp and a second lamp at a lighting level selected from a plurality of lamp lighting levels. The method includes: receiving an alternating current (AC) voltage signal and producing a rectified voltage signal therefrom; providing an energizing signal from the rectified voltage signal, wherein the energizing signal powers the first lamp and the second lamp, and wherein the energizing signal is power factor corrected; selectively reducing a current applied to the first lamp and the second lamp by the energizing signal; and selectively preventing the second lamp from being energized by the energizing signal.

In a related embodiment, the method may further include: operating the first lamp and the second lamp in at least one of a first mode, a second mode, and a third mode; wherein when operated in the first mode, the current applied to the first lamp and the second lamp by the energizing signal is not reduced and the second lamp is not prevented from being energized by the energizing signal; wherein when operated in the second mode, the current applied to the first lamp and the second lamp by the energizing signal is reduced and the second lamp is not prevented from being energized by the energizing signal; and wherein when operated in the third mode, the current applied to the first lamp by the energizing signal is reduced and the second lamp is preventing from being energized by the energizing signal.

In a further related embodiment, the method may further include isolating a control circuit provided to control and operate the first lamp and the second lamp in any of the first mode, the second mode, and the third mode. In a further related embodiment, isolating may include isolating the control circuit by an optocoupler. In a further related embodiment, the control circuit may control a switch array to selectively bypass a capacitor in series with the lamps and the control circuit may control a switch to selectively connect a short circuit in parallel with the second lamp.

In another embodiment, at least a third lamp may be in parallel with the first lamp and selectively reducing may include selectively reducing the current applied to the first lamp, the second lamp, and the third lamp by the energizing signal, and operating may include operating the first lamp and the second lamp and the third lamp in at least one of a first mode, a second mode, and a third mode, wherein the first mode may include a first mode in which the current applied to the first lamp, the second lamp, and the third lamp by the energizing signal is not reduced and the second lamp is not prevented from being energized by the energizing signal; wherein the second mode may include a second mode in which the current applied to the first lamp, the second lamp, and the third lamp by the energizing signal is reduced and the second lamp is not prevented from being energized by the energizing signal; and wherein the third mode may include a third mode in which the current applied to the first lamp and the third lamp by the energizing signal is reduced and the second lamp is prevented from being energized by the energizing signal.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

An instant start electronic ballast operates lamps at three different, discrete light levels based on a line switch configuration as selected by a user. For example, at a first level, the ballast may operate the lamps at 100% of their total light output (i.e., a maximum light level); at a second level, the ballast may operate the lamps at 60% of their total light output (i.e., a 60% light level); and at a third level, the ballast may short one lamp and operate the remaining lamp or lamps at the 60% light level. Of course, other such light levels may be used.

Figure 1:
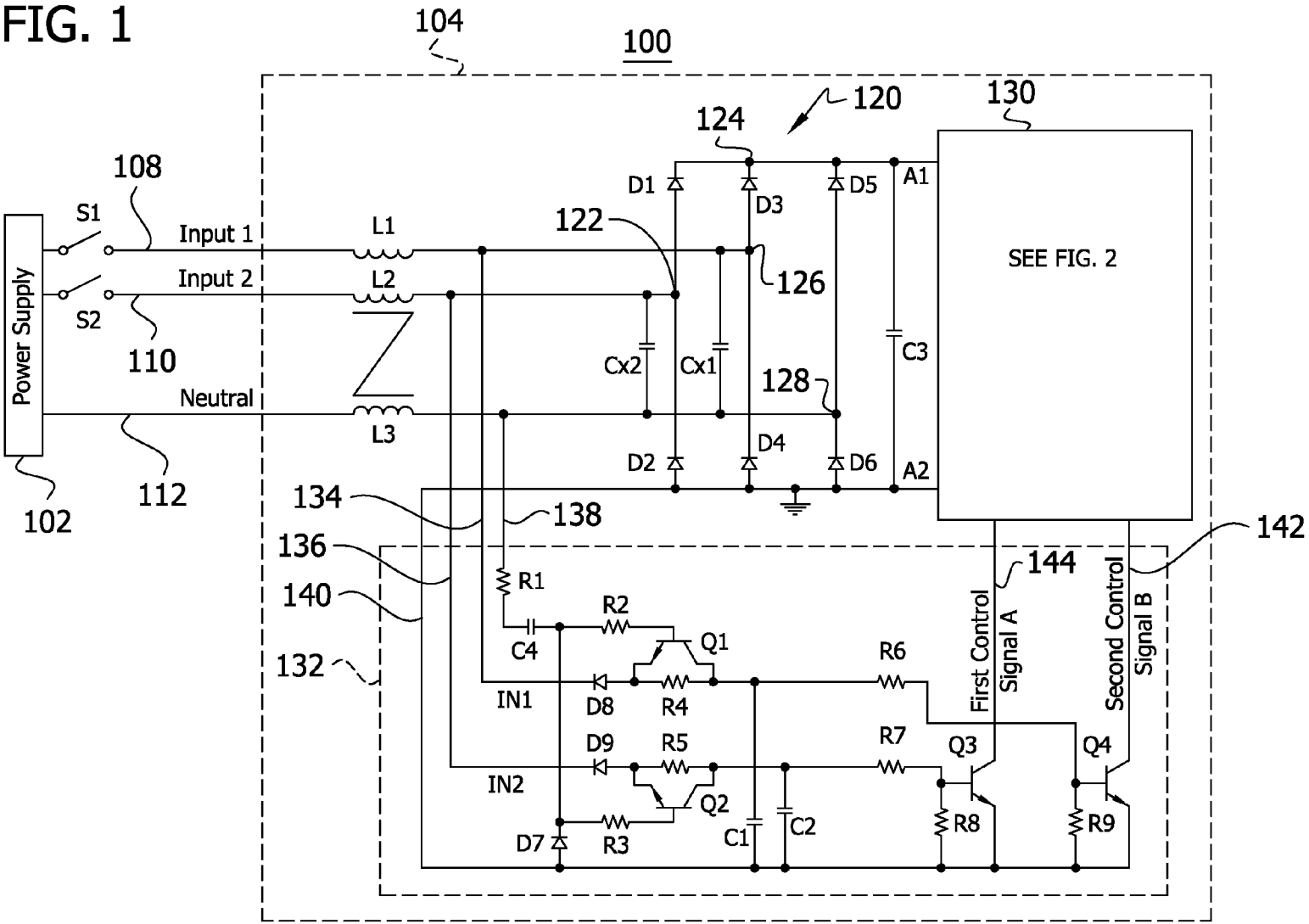
FIG. 1 shows a partial schematic diagram, partially in block form, of a lamp system including a rectifier and control circuits, according to embodiments described herein.
Figure 2:
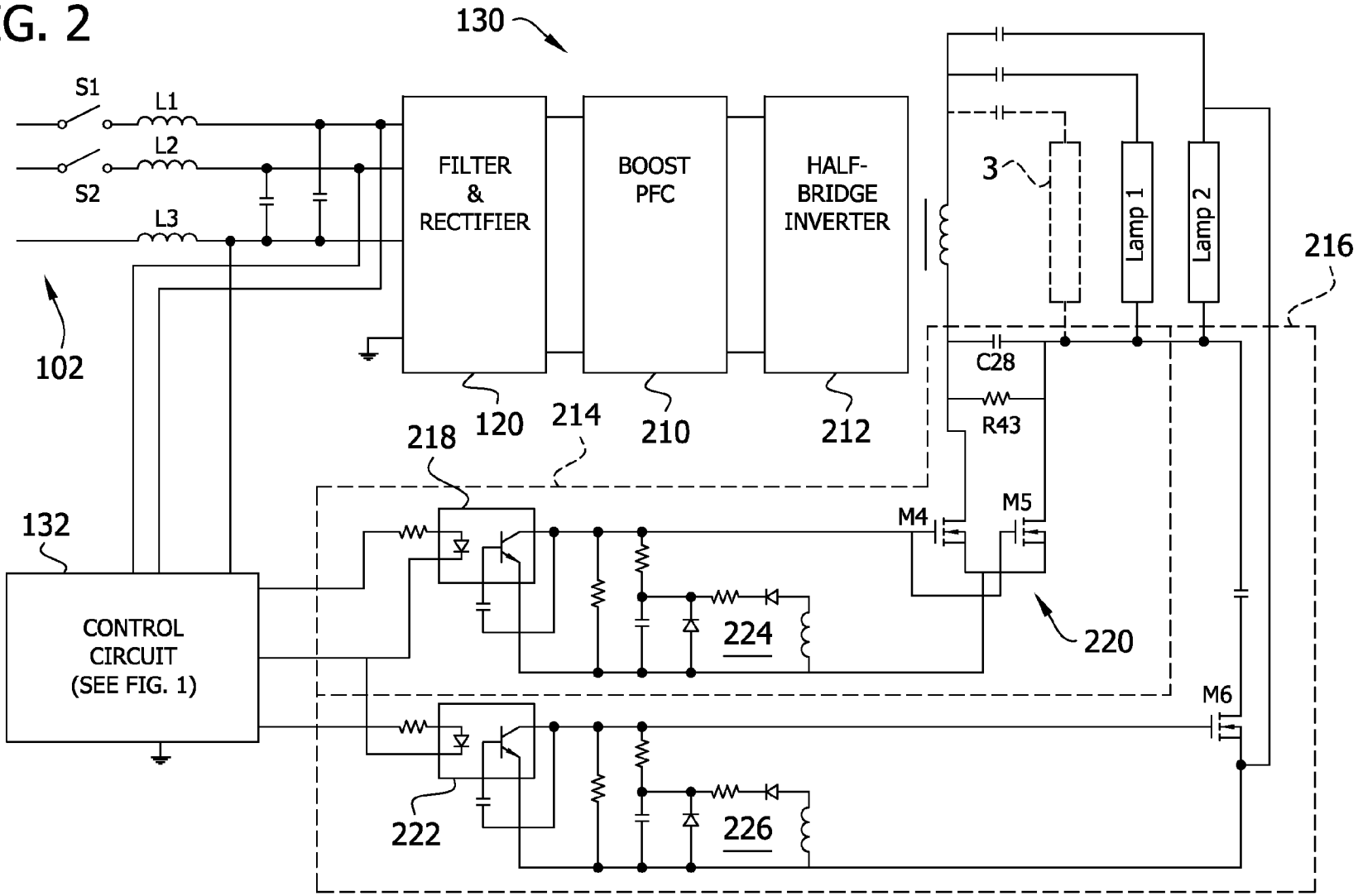
FIG. 2 shows a partial schematic diagram, partially in block form, of a lamp system including a converter, lamp control, and lamp circuit, according to embodiments described herein.

FIG. 1 illustrates a lighting system 100 according to embodiments disclosed herein. The lighting system 100 includes a control circuit 132, which may be used to sense the position of a first switch S1 and a second switch S2. See U.S. patent application Ser. No. 13/077,151, filed Mar. 31, 2011, the entire disclosure of which is incorporated herein by reference, for a more detailed description of the control circuit. The lighting system 100 also includes an input power source, such as an alternating current (AC) power supply 102 (e.g., standard 120V or 240V AC household power), and a ballast 104 for energizing a plurality of lamps (shown in FIG. 2). The plurality of lamps may be connected together in parallel or in series. Although only two lamps connected together in parallel are illustrated in FIG. 2, the lighting system 100 may include any number of lamps connected together parallel or in series. In some embodiments, one or more of the lamps is a T8 type lamp. The lighting system 100 may be used for energizing other types of lamps not specifically mentioned herein without departing from the scope of the invention.

The lighting system 100 also includes a first high voltage input terminal 108 (i.e., line voltage input terminal, hot input terminal) that is connectable to a first high voltage terminal (e.g., hot wire) of the AC power supply 102, a second high voltage input terminal 110 (i.e., line voltage input terminal) that is connectable to a second high voltage terminal of the AC power supply 102, a neutral input terminal 112 connected to a neutral wire of the AC power supply 102, and a ground terminal (not shown) connectable to a ground potential. The first switch 51 is connected to the first high voltage input terminal 108. Accordingly, the first switch 51 is able to selectively connect the ballast 104 to the first high voltage terminal of the AC voltage source 102. The second switch S2 is connected to the second high voltage input terminal 110. As such, the second switch S2 is able to selectively connect the ballast 104 to the second high voltage terminal of the AC voltage source 102. The first switch S1 and the second switch S2 may be implemented by, for example but not limited to, conventional wall switches having an on state and an off state.

A rectifier circuit 120 is coupled to the first high voltage input terminal 108, the second high voltage input terminal 110, and the neutral terminal 112. The rectifier circuit 120 includes a first electromagnetic interference (EMI) inductor L1, a second EMI inductor L2, a third EMI inductor L3, and EMI capacitors Cx1 and Cx2. As shown in FIG. 1, the rectifier circuit 120 is a full-wave rectifier implemented by an arrangement comprising six diodes D1, D2, D3, D4, D5, and D6. In operation, the ballast 104 selectively receives a sinusoidal AC voltage signal from the AC power supply 102 via the first switch S1 and/or the second switch S2. Specifically, the rectifier circuit 120 receives the AC voltage signal and generates a rectified voltage signal therefrom. A high frequency bypass capacitor C3 reduces high frequency noise in the rectified voltage signal. A lighting system converter and lamp control circuit 130 (see FIG. 2) is coupled to the rectifier circuit 120 via the high frequency bypass capacitor C3. The lighting system converter and lamp control circuit 130 receives the rectified voltage signal and provides a voltage and current suitable to energize the lamps. In some embodiments, such as is illustrated in FIG. 2, the lighting system converter and lamp control 130 includes a power factor correction circuit 210 and an inverter circuit 212.

The ballast 104 also includes a control circuit, such as but not limited to a switch status detection circuit 132, which provides control signals to the lighting system converter and lamp control circuit 130 as a function of the states of the first switch S1 and the second switch S2. In some embodiments, the first control signal (a control signal 144) is a voltage signal having a magnitude (e.g., voltage level) that is dependent on the state of the first switch S1. The second control signal (a control signal 142) is a voltage signal having a magnitude (e.g., voltage level) that is dependent on the state of the second switch S2. In turn, the lighting system converter and lamp control circuit 130 provides a voltage signal to the lamps as a function of the control signal(s). The lamps generate a particular amount of light (e.g., lumens, light level, lighting level) as a function of the voltage signal (e.g., voltage level, voltage magnitude) provided to the lamps by the lighting system converter and lamp control circuit 130.

For example, in FIG. 1, when the first switch S1 is in the off state, the magnitude of the first control signal 144 is at a first level (e.g., low level, 0 volts). When the first switch S1 is in the on state, the magnitude of the first control signal 144 is at a second level (e.g., high level, 5 volts). Similarly, when the second switch S2 is in the off state, the magnitude of the second control signal 142 is at a first level (e.g., low level, 0 volts). When the second switch S2 is in the on state, the magnitude of the second control signal 142 is at a second level (e.g., high level, 5 volts). The lamps are off when the both the first control signal and the second control signal are at the first level.

In some embodiments, the switch status detection circuit 132 includes a first input terminal 134 coupled to the first switch S1 via the first inductor L1, and a second input terminal 136 coupled to the second switch via the second inductor L2. A third input terminal 138 is coupled to the neutral input terminal 112 of the AC voltage supply 102, and a ground terminal 140 is coupled to a ground potential. In operation, the first input terminal 134 receives a first voltage signal from the AC power supply 102, and the second input terminal 136 receives a second voltage signal from the AC power supply 102. The switch status detection circuit 132 also includes a first output terminal 142 and a second output terminal 144, both connected to the lighting system converter and lamp control circuit 130. The first control signal indicates that the status of the first switch S1 is provided to the control circuit 130 via the first output terminal 142. The second control signal indicates the status of the second switch S2 is provided to the control circuit 130 via the second output terminal 144. A neutral synchronization circuit is connected between the third input terminal 138 and the ground terminal 140 for generating a positive pulsed current signal as a function of the neutral voltage signal. The switch status detection circuit 132 also includes a first detection channel and a second detection channel. The first detection channel is connected to the neutral synchronization circuit, the first input terminal 134, and the first output terminal 142 of the switch status detection circuit 132 for generating the first control signal. In operation, the first input terminal 134, the second input terminal 136, and the third input terminal 138 each receive a voltage signal relative to ground potential generated from an AC voltage signal from the AC power supply 102. The AC voltage signal provided by the AC power supply 102 is rectified to produce the voltage signal, which consists of positive half waves.

FIG. 2 illustrates a lighting system 100, which includes a power factor correction circuit 210 connected to the first and second output terminals of the EMI filter and rectifier 120. In some embodiments, the power factor correction circuit 210 may be a boost converter. The power factor correction circuit 210 receives the rectified DC voltage and produces a high DC voltage on a high DC voltage bus. For example, the power factor correction circuit 210 may provide a voltage of around 450 volts to the high DC voltage bus. A half bridge current fed inverter circuit 212 having an inverter input is connected to the power factor correction circuit 210 for receiving the high DC voltage and converting it to AC voltage. In some embodiments, the inverter circuit 212 includes a protection circuit. The protection circuit senses the AC voltage signal being provided to lamps connected within the lighting system 100 (i.e., any of lamp 1, lamp 2, etc. shown in FIG. 2) and shuts down the inverter circuit 212 if the AC voltage exceeds a predefined threshold value. For example, the protection circuit is able to shut down the inverter circuit 212 when there is no lamp connected to the lighting system 100, because no is present or because wires used to connect lamps to the lighting system 100 have become disconnected during normal operation. In some embodiments, the inverter output is connected to a resonant circuit.

The following Table 1 summarizes one exemplary embodiment of the three light levels according to the invention, illustrating voltage, current, power and frequency.

TABLE 1

| A (LS) | B (CutOff) | Light Level | $V_{in}$ (V) | $I_{in}$ (mA) | $P_{in}$ (W) | $V_{lamp1}$ (V) | $I_{lamp1}$ (mA) | $P_{lamp1}$ (W) | Freq (kHz) |
|---|---|---|---|---|---|---|---|---|---|
| Low | High | Bright | 120.006 | 468.2 | 55.94 | 142.41 | 179.4 | 24.996 | 42.886 |
| High | High | Medium | 120.015 | 313.97 | 36.686 | 153.924 | 108.32 | 16.312 | 54.067 |
| High | Low | Dim | 120.022 | 168.728 | 19.662 | 156.328 | 100.69 | 15.447 | 53.896 |
| A (LS) | B (CutOff) | Light Level | $V_{in}$ (V) | $I_{in}$ (mA) | $P_{in}$ (W) | $V_{lamp2}$ (V) | $I_{lamp2}$ (mA) | $P_{lamp2}$ (W) | Freq (kHz) |
| Low | High | Bright | 120.006 | 468.2 | 55.94 | 140.7 | 181.3 | 24.94 | 42.886 |
| High | High | Medium | 120.015 | 313.97 | 36.686 | 149.497 | 110.32 | 16.134 | 54.067 |
| High | Low | Dim | 120.022 | 168.728 | 19.662 | NA | NA | NA | 53.896 |

One embodiment of the operation of the invention in various modes is summarized in Table 2 below. The modes are controlled and implemented by the control circuit 132. In operation in MODE 1 (bright light intensity), the switch S1 is open and the switch S2 is closed, resulting in the first control signal being at the LOW level and the second control signal being at the HIGH level. As a result, the lighting system converter and lamp control circuit 130 operates the lamps 1 and 2 to produce a first lighting level (e.g., 100 percent of the rated lamp current for lamps 1 and 2 together). In MODE 2 (medium light intensity), the switch S1 is closed and the switch S2 is closed, resulting in the first control signal being at the HIGH level and the second control signal is at the HIGH level. As a result, the lighting system converter and lamp control circuit 130 operates the lamps 1 and 2 to produce a second lighting level (e.g., 60 percent of the rated lamp current for lamps 1 and 2 together). In MODE 3 (dim light intensity), the switch S1 is closed and the switch S2 is open, resulting in the first control signal being at the HIGH level and the second control signal being at the LOW level. As a result, the lighting system converter and lamp control circuit 130 operates the lamp 1 to produce a third lighting level (e.g., 60 percent of the rated lamp current for the lamp 1 only and the lamp 2 is not energized).

TABLE 2

| | | S1 | S1 | FIRST CONTROL SIGNAL A | SECOND CONTROL SIGNAL B | LAMP 1/ current | LAMP 2/ current |
|---|---|---|---|---|---|---|---|
| MODE 1 | Bright | Open | Closed | Low | High | On/100% | On/100% |
| MODE 2 | Medium | Closed | Closed | High | High | On/60% | On/60% |
| MODE 3 | Dim | Closed | Open | High | Low | On/60% | Off/0% |

Thus, in the one form, the invention comprises a ballast for selectively energizing from an alternating current (AC) power supply 102 at least first and second lamps 1, 2 at a lighting level selected from a plurality of three different lamp lighting levels. The rectifier front end 120 receives an alternating current (AC) voltage signal and produces a rectified voltage signal adjusted by the PFC circuit 210. The inverter circuit 212 receives the adjusted, rectified voltage signal and provides the energizing signal via a transformer for powering the first lamp 1 and the second lamp 2. A first lamp control circuit 214 selectively reduces the current applied to the first and second lamps by the energizing signal by selectively introducing and eliminating a short circuit bypass connected in parallel with an impedance device in the path of the current applied to the lamps. A second lamp control circuit 216 selectively prevents and permits the energizing of the second lamp 2 by selectively introducing and eliminating a short circuit bypass connected in parallel with the second lamp 2. The control circuit 132 controls the first circuit 214 to selectively reduce current applied to the lamps 1, 2 and controls the second circuit 216 to selectively prevent the energizing of the second lamp 2.

As summarized above in Table 2, the control circuit 130 controls the first lamp control circuit 214 and the second lamp control circuit 216 in first, second and third modes of lighting levels, as follows. In the first mode having a bright light level, the first circuit 214 does not reduce the current applied to the first and second lamps 1, 2 by the energizing signal from the inverter circuit 212. In the illustrated embodiment, this is accomplished by bypassing capacitor C28 with a short circuit in parallel with the capacitor C28. In the first mode, the second circuit 216 does not prevent the second lamp 2 from being energized by the energizing signal from the inverter circuit 212. In the illustrated embodiment, this is accomplished by not bypassing the second lamp 2 with a short circuit.

In the second mode having a medium or intermediate light level, the first circuit 214 reduces the current applied to the first and second lamps 1, 2 by the energizing signal from the inverter circuit 212. In the illustrated embodiment, this is accomplished by not bypassing capacitor C28 with a short circuit so that the capacitor C28, in series with the lamps, offers impedance to the current applied to lamps 1, 2. In the second mode, the second circuit 216 does not prevent the second lamp 2 from being energized by the energizing signal from the inverter circuit 212. In the illustrated embodiment, this is accomplished by not bypassing the second lamp 2 with a short circuit.

In the third mode having the dim light level, the second circuit 216 prevents the second lamp 2 from being energized by the energizing signal from the inverter circuit 212. In the illustrated embodiment, this is accomplished by bypassing the second lamp 2 with a short circuit. In the third mode, the first circuit 214 reduces the current applied to the first lamp 1 by the energizing signal from the inverter circuit 212. In the illustrated embodiment, this is accomplished by not bypassing capacitor C28 with a short circuit so that the capacitor C28 offers impedance to the current applied to lamp 1. Because of the short circuit in parallel with lamp 2, lamp 2 is bypassed and no current is applied to lamp 2.

As noted herein, the invention also contemplates two or more lamps in parallel with lamp 1. For example, at least a third lamp, lamp 3 (shown in phantom in FIG. 2) may be connected in parallel with the lamp 1 so the first circuit selectively reduces the current applied to the first, second and third lamps by the energizing signal. The control circuit 132 controls the first circuit 214 and second circuit 216 similar to the control as noted for two lamps. In a first mode, the first circuit 214 does not reduce the current applied to lamps 1-3 by the energizing signal and the second circuit 216 does not prevent lamp 2 from being energized by the energizing signal. In a second mode, the first circuit 214 reduces the current applied to lamps 1-3 by the energizing signal and the second circuit 216 does not prevent lamp 3 from being energized by the energizing signal. In a third mode, the first circuit 214 reduces the current applied to the lamps 1, 3 by the energizing signal and the second circuit prevents lamp 2 from being energized by the energizing signal.

In some embodiments, the first circuit 214 comprises an isolating circuit such as a first optocoupler 218 controlling a solid state switch array 220 selectively bypass a capacitor C28 in series with the lamps 1-2. Similarly, the second circuit 216 comprises a second isolating circuit such as a second optocoupler 222 controlling a switch 224 to selectively connect a short circuit in parallel with lamp 2. Thus, the first and second isolating circuits are isolated from each other and from the control circuit. In some embodiments, the first circuit 214 comprises a capacitive device (e.g., a capacitor C28) connected in series with the lamps 1-2 and a short circuit selectively connected in parallel with the capacitive device. Similarly, the second circuit 216 comprises sa short circuit selectively connected in parallel with lamp 2.

As illustrated in FIG. 2, the solid state switches may be n-channel MOSFETs M4 and M5. A first driver circuit 224 controls a gate of MOSFETs M4 and M5 to selectively short circuit the capacitor C28 in response to the signal provided by optocoupler 218. A resistor R43 may be connected in parallel with the capacitor C28 to reduce surges. When signal A is low, the MOSFETs M4 and M5 are ON and the capacitor C28 is bypassed by a short circuit so that both lamps 1-2 operate with full current at a maximum level. When signal A is high, the MOSFETs M4 and M5 are OFF and the capacitor C28 falls in the path of the return leg of the lamp current offering impedance so that both lamps 1-2 operate with reduced current at a reduced level. The reduced level of operation depends on the value of the capacitor C28. In some embodiments, the current through the capacitor C28 may be limited to 60%, though of course other values may be used.

A second driver circuit 226 controls a gate of a MOSFET M6 to selectively short circuit the lamp 2 in response to the signal provided by optocoupler 222. When signal B is high, the MOSFET M6 is OFF, thereby open-circuiting the bypass of voltage across the lamp 2, allowing the lamp 2 to be energized and operate. If signal B is high and signal A is low, the lamps 1-2 operate at full current. If signal B is high and signal A is high, the lamps 1-2 operate at reduced current because the capacitor C28 impedes current flowing through both lamps. When signal B is low, the MOSFET M6 is ON, thereby shorting the voltage across the lamp 2 and extinguishing it. If signal B is low and signal A is high, the lamp 2 is bypassed by a short circuit and OFF and the lamp 1 operates at reduced current, because the capacitor C28 impeded current flowing through the lamp 1. Signals A and B can be in the above three noted states, depending upon the state of the first and second switches S1 and S2 (see Table 2 above). A fourth state for signals A and B, in which both are low, is not possible as the ballast will not be powered because both the first and second switches S1 and S2 would be open in this fourth state.

It is also contemplated that other combinations of the first and second lamp control circuits may be employed with additional lamps. Also, other or additional switches other than the first and second switches S1 and S2 may be used to control the control circuit. Two or more lamps may be connected in series or in parallel with either the lamp 1 or the lamp 2 or both.

Figure 3:
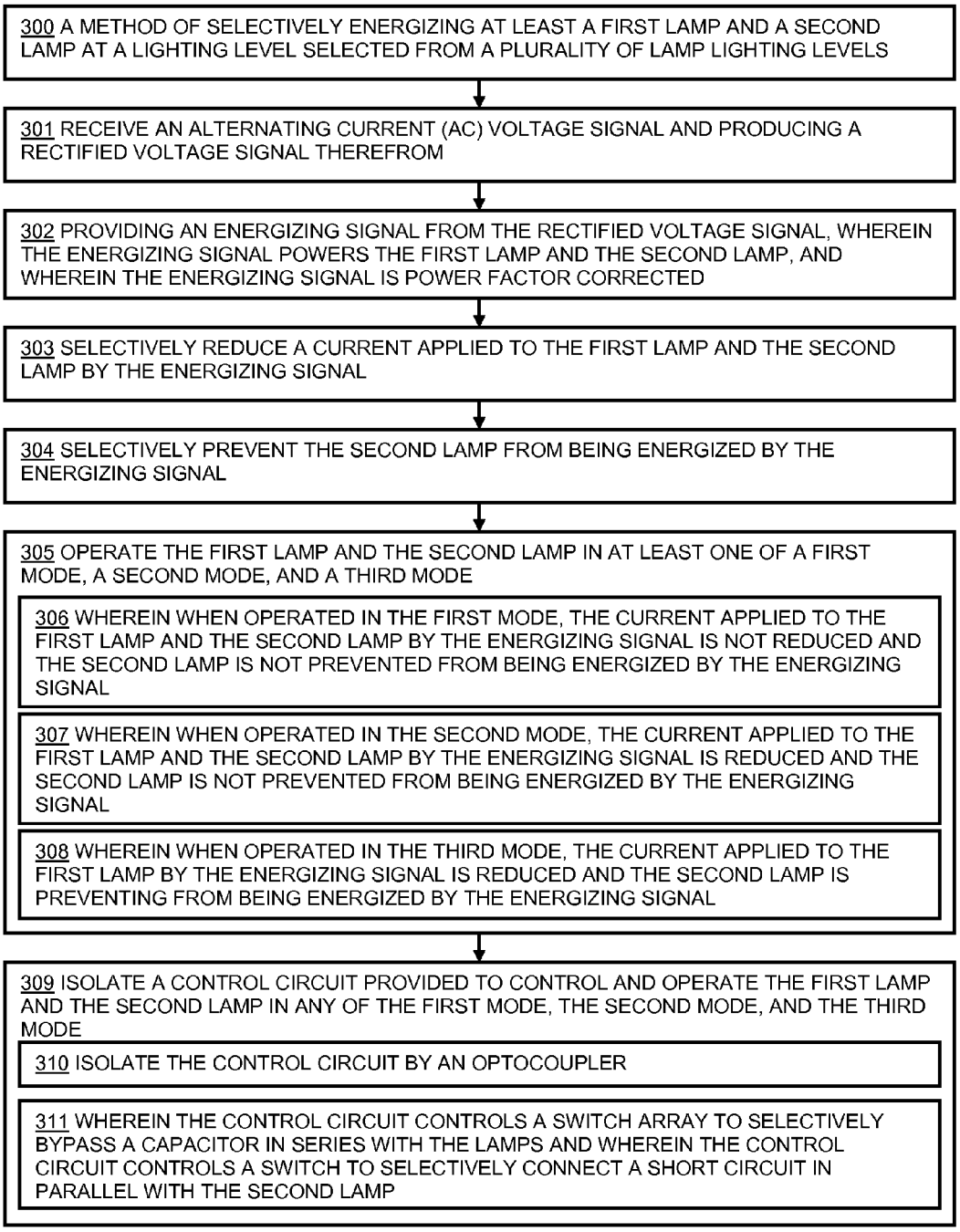
FIGS. 3 and 4 are block flow diagrams of methods according to embodiments disclosed herein.
Figure 4:
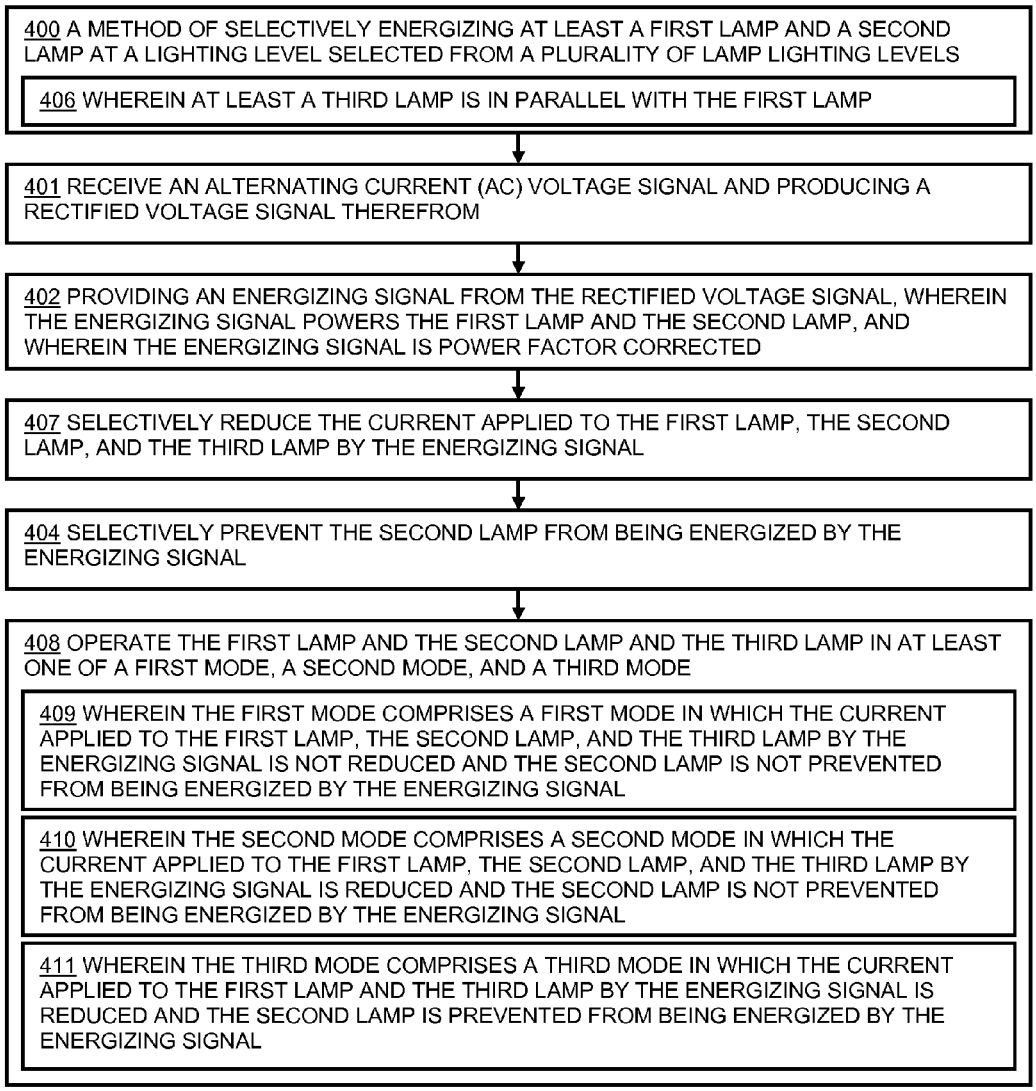

FIGS. 3 and 4 are flowcharts of methods 300 and 400 of, respectively, selectively energizing at least a first lamp and a second lamp at a lighting level selected from a plurality of lamp lighting levels. The flowcharts illustrate the functional information one of ordinary skill in the art requires to fabricate circuits or to otherwise perform the operations required in accordance with the present invention. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order. In addition, it is to be understood that other embodiments may include subcombinations of the illustrated steps and/or additional steps described herein. Thus, claims presented herein may be directed to all or part of the components and/or operations depicted in one or more figures.

More particularly, FIGS. 3 and 4 are block flow diagrams of methods 300 and 400 of selectively energizing, respectively, at least a first lamp and a second lamp, and a third lamp in parallel with the first lamp, step 406, at a lighting level selected from a plurality of lamp lighting levels. An alternating current (AC) voltage signal is received and a rectified voltage signal is produced therefrom, step 301/401. An energizing signal is provided from the rectified voltage signal, step 302/402. The energizing signal powers the first lamp and the second lamp, and in embodiments including the third lamp, the third lamp, and the energizing signal is power factor corrected. The current applied to the first lamp and the second lamp by the energizing signal is selectively reduced, step 303, and similarly for the third lamp, step 407. The second lamp is selectively prevented from being energized by the energizing signal, step 304/404. The first lamp and the second lamp are operated in at least one of a first mode, a second mode, and a third mode, step 305, and similarly for the third lamp, step 408.

In embodiments where three lamps are present, the first mode comprises a first mode in which the current applied to the first lamp, the second lamp, and the third lamp by the energizing signal is not reduced and the second lamp is not prevented from being energized by the energizing signal, step 409. Similarly, the second mode comprises a second mode in which the current applied to the first lamp, the second lamp, and the third lamp by the energizing signal is reduced and the second lamp is not prevented from being energized by the energizing signal, step 410. Similarly, the third mode comprises a third mode in which the current applied to the first lamp and the third lamp by the energizing signal is reduced and the second lamp is prevented from being energized by the energizing signal, step 411.

In embodiments where only two lamps are present, when operated in the first mode, the current applied to the first lamp and the second lamp by the energizing signal is not reduced and the second lamp is not prevented from being energized by the energizing signal, step 306. When operated in the second mode, the current applied to the first lamp and the second lamp by the energizing signal is reduced and the second lamp is not prevented from being energized by the energizing signal, step 307. When operated in the third mode, the current applied to the first lamp by the energizing signal is reduced and the second lamp is preventing from being energized by the energizing signal, step 308. Further, the method 300 may include isolating a control circuit provided to control and operate the first lamp and the second lamp in any of the first mode, the second mode, and the third mode, step 309, in which the control circuit may be isolated by an optocoupler, step 310. The control circuit may then further control a switch array, step 311, to selectively bypass a capacitor in series with the lamps and wherein the control circuit controls a switch to selectively connect a short circuit in parallel with the second lamp.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

a rectifier to receive an alternating current (AC) voltage signal and produce a rectified voltage signal therefrom;

a power factor correction circuit to receive the rectified voltage signal and provide a corrected voltage signal;

an inverter circuit to receive the corrected voltage signal and provide an energizing signal that powers a first lamp and a second lamp;

a first circuit to selectively reduce the current applied to the first lamp and the second lamp by the energizing signal;

a second circuit to selectively prevent the second lamp from being energized by the energizing signal; and a control circuit to control the first circuit to selectively reduce current applied to the first lamp and the second lamp, and to control the second circuit to selectively prevent the energizing of the second lamp;

wherein the first circuit comprises a capacitive device connected in series with the first lamp and a short circuit selectively connected in parallel with the capacitive device, and wherein the second circuit comprises a short circuit selectively connected in parallel with the second lamp.

2. The ballast of claim 1, wherein the control circuit includes a first control mode, a second control mode, and a third control mode, wherein:

in the first control mode, the control circuit controls the first circuit so as to not reduce the current applied to the first and second lamps by the energizing signal and the second circuit so as to not prevent the second lamp from being energized by the energizing signal;

in the second control mode, the control circuit controls the first circuit so as to reduce the current applied to the first and second lamps by the energizing signal and the second circuit so as to not prevent the second lamp from being energized by the energizing signal; and in the third control mode, the control circuit controls the first circuit so as to reduce the current applied to the first lamp by the energizing signal and the second circuit so as to prevent the second lamp from being energized by the energizing signal.

3. The ballast of claim 2, wherein at least a third lamp is in parallel with the first lamp and wherein the first circuit selectively reduces the current applied to the first lamp, the second lamp, and the third lamp by the energizing signal and wherein the control circuit includes a first control mode, a second control mode, and a third control mode, wherein:

in the first control mode, the control circuit controls the first circuit so as to not reduce the current applied to the first lamp, the second lamp, and the third lamp by the energizing signal, and controls the second circuit so as to not prevent the second lamp from being energized by the energizing signal;

in the second control mode, the control circuit controls the first circuit so as to reduce the current applied to the first lamp, the second lamp, and the third lamp by the energizing signal, and controls the second circuit so as to not prevent the second lamp from being energized by the energizing signal; and in the third control mode, the control circuit controls the first circuit so as to reduce the current applied to the first lamp and the third lamp by the energizing signal, and controls the second circuit so as to prevent the second lamp from being energized by the energizing signal.

4. The ballast of claim 1, further comprising:

a first isolating circuit interconnecting the control circuit to the first circuit; and a second isolating circuit interconnecting the control circuit to the second circuit;

wherein the first isolating circuit and the second isolating circuit are isolated from each other and from the control circuit.

5. The ballast of claim 4, wherein the first isolating circuit and the second isolating circuit each comprise an optocoupler and at least one solid state switch.

6. The ballast of claim 4, wherein the first isolating circuit comprises a first optocoupler controlling a switch array to selectively bypass a capacitor in series with the first lamp and the second lamp, and wherein the second isolating circuit comprises a second optocoupler controlling a switch to selectively connect a short circuit in parallel with the second lamp.

7. A ballast to selectively energize at least a first lamp and a second lamp at a lighting level selected from a plurality of lamp lighting levels, the ballast comprising:

a first switch adapted to selectively connect the ballast to a first high voltage terminal of an AC power supply, the first switch having an on state and an off state;

a second switch adapted to selectively connect a power converter to a second high voltage terminal of the AC power supply, the second switch having an on state and an off state;

a rectifier to receive an alternating current (AC) voltage signal and produce a rectified voltage signal therefrom;

a power factor correction circuit to receive the rectified voltage signal and provide a corrected voltage signal;

an inverter circuit to receive the corrected voltage signal and providing an energizing signal to power the first lamp and the second lamp;

a first circuit to selectively reduce the current applied to the first lamp and the second lamp by the energizing signal;

a second circuit to selectively prevent the second lamp from being energized by the energizing signal; and a control circuit responsive to the first switch and the second switch to selectively control the first circuit and the second circuit.

8. The ballast of claim 7, wherein the control circuit:

in response to the first switch being in an off state and the second switch being in an on state, controls the first circuit and the second circuit in a first mode in which the first circuit does not reduce the current applied to the first lamp and the second lamp by the energizing signal and the second circuit does not prevent the second lamp from being energized by the energizing signal, such that both the first lamp and the second lamp are operated at a maximum lamp lighting level in the plurality of lamp lighting levels;

in response to the first switch being in an on state and the second switch being in an on state, controls the first circuit and the second circuit in a second mode in which the first circuit reduces the current applied to the first lamp and the second lamp by the energizing signal and the second circuit does not prevent the second lamp from being energized by the energizing signal, such that both the first lamp and the second lamp are operated at a 60% lamp lighting level in the plurality of lamp lighting levels; and in response to the first switch being in an on state and the second switch being in an off state, controls the first circuit and the second circuit in a third mode in which the first circuit reduces the current applied to the first lamp by the energizing signal and the second circuit prevents the second lamp from being energized by the energizing signal, such that the first lamp is operated at the 60% lamp lighting level in plurality of lamp lighting levels.

9. The ballast of claim 8 wherein at least a third lamp is in parallel with the first lamp and wherein the first circuit selectively reduces the current applied to the first, second and third lamps by the energizing signal and wherein the control circuit controls the first and second circuits:

in a first mode in which the first circuit does not reduce the current applied to the first, second and third lamps by the energizing signal and the second circuit does not prevent the second lamp from being energized by the energizing signal;

in a second mode in which the first circuit reduces the current applied to the first, second and third lamps by the energizing signal and the second circuit does not prevent the second lamp from being energized by the energizing signal; and in a third mode in which the first circuit reduces the current applied to the first and third lamps by the energizing signal and the second circuit prevents the second lamp from being energized by the energizing signal.

10. The ballast of claim 7, further comprising:

a first isolating circuit interconnecting the control circuit to the first circuit; and a second isolating circuit interconnecting the control circuit to the second circuit;

wherein the first isolating circuit and the second isolating circuit are isolated from each other and from the control circuit.

11. The ballast of claim 10, wherein each isolating circuit comprises an optocoupler and at least one solid state switch.

12. The ballast of claim 10, wherein the first isolating circuit comprises a first optocoupler controlling a switch array to selectively bypass a capacitor in series with the lamps and wherein the second isolating circuit comprises a second optocoupler controlling a switch to selectively connect a short circuit in parallel with the second lamp.

13. The ballast of claim 7, wherein the first circuit comprises a capacitive device connected in series with the first lamp and a short circuit selectively connected in parallel with the capacitive device, and wherein the second circuit comprises a short circuit selectively connected in parallel with the second lamp.

14. A method of selectively energizing at least a first lamp and a second lamp at a lighting level selected from a plurality of lamp lighting levels, the method comprising:

receiving an alternating current (AC) voltage signal and producing a rectified voltage signal therefrom;

providing an energizing signal from the rectified voltage signal, wherein the energizing signal powers the first lamp and the second lamp, and wherein the energizing signal is power factor corrected;

selectively reducing a current applied to the first lamp and the second lamp by the energizing signal;

selectively preventing the second lamp from being energized by the energizing signal; and operating the first lamp and the second lamp in at least one of a first mode, a second mode, and a third mode;

wherein when operated in the first mode, the current applied to the first lamp and the second lamp by the energizing signal is not reduced and the second lamp is not prevented from being energized by the energizing signal;

wherein when operated in the second mode, the current applied to the first lamp and the second lamp by the energizing signal is reduced and the second lamp is not prevented from being energized by the energizing signal; and wherein when operated in the third mode, the current applied to the first lamp by the energizing signal is reduced and the second lamp is preventing from being energized by the energizing signal.

15. The method of claim 14, further comprising isolating a control circuit provided to control and operate the first lamp and the second lamp in any of the first mode, the second mode, and the third mode.

16. The method of claim 15, wherein isolating comprises isolating the control circuit by an optocoupler.

17. The method of claim 16, wherein the control circuit controls a switch array to selectively bypass a capacitor in series with the lamps and wherein the control circuit controls a switch to selectively connect a short circuit in parallel with the second lamp.

18. The method of claim 14, wherein at least a third lamp is in parallel with the first lamp and wherein selectively reducing comprises selectively reducing the current applied to the first lamp, the second lamp, and the third lamp by the energizing signal, and wherein operating comprises operating the first lamp and the second lamp and the third lamp in at least one of a first mode, a second mode, and a third mode;

wherein the first mode comprises a first mode in which the current applied to the first lamp, the second lamp, and the third lamp by the energizing signal is not reduced and the second lamp is not prevented from being energized by the energizing signal;

wherein the second mode comprises a second mode in which the current applied to the first lamp, the second lamp, and the third lamp by the energizing signal is reduced and the second lamp is not prevented from being energized by the energizing signal; and wherein the third mode comprises a third mode in which the current applied to the first lamp and the third lamp by the energizing signal is reduced and the second lamp is prevented from being energized by the energizing signal.

* * * * *